US005795136A

United States Patent [19]

Olsaker et al.

[11] Patent Number: 5,795,136

[45] Date of Patent: Aug. 18, 1998

[54] ENCAPSULATED ROTARY SCREW AIR COMPRESSOR

[75] Inventors: Oleif Olsaker; James T. Ferentinos; Dale A. Schultz, all of Michigan City, Ind.

[73] Assignee: Sundstrand Corporation, Rockford, Ill.

[21] Appl. No.: 779,554

[22] Filed: Jan. 8, 1997

Related U.S. Application Data

[63] Continuation of Ser. No. 566,527, Dec. 4, 1995, abandoned.

[51] Int. Cl.[6] ..... F04B 39/02; F04C 29/02

[52] U.S. Cl. ..... 417/295; 417/410.4; 418/89; 418/100; 418/104; 418/201.1; 418/DIG. 1; 184/6.16

[58] Field of Search ..... 417/295, 410.3, 417/410.4; 418/88, 89, 100, 104, 201.1, 201.2, DIG. 1; 184/6.16

[56] References Cited

U.S. PATENT DOCUMENTS

| | | | |
|---|---|---|---|
| 4,420,293 | 12/1983 | Hofmann | 418/DIG. 1 |
| 4,563,138 | 1/1986 | Hofmann et al. | 418/DIG. 1 |
| 4,761,123 | 8/1988 | Sowards et al. | 418/89 |
| 5,156,532 | 10/1992 | Arndt et al. | 418/104 |

FOREIGN PATENT DOCUMENTS

| | | | |
|---|---|---|---|
| 0606965 | 7/1994 | European Pat. Off. | 418/104 |
| 203599 | 10/1983 | German Dem. Rep. | 418/DIG. 1 |
| 60-101294 | 6/1985 | Japan | 418/DIG. 1 |

*Primary Examiner*—John J. Vrablik
*Attorney, Agent, or Firm*—Sundstrand Corporation

[57] ABSTRACT

A rotary screw compressor system is provided wherein the base plate connecting the prime mover to the compressor integrates the drive transmission with the lubricating fluid flow path between lubricating circuit components. Each of those circuit components and the compressor is removably mounted to the base plate via segregating housings. The compressor is mounted to the base plate with drive shaft and working fluid outlet on the same side. A pre-separation chamber is included within the base plate to facilitate removal of lubricant from the compressed working fluid prior to passage of the working fluid through the separator component. A double seal arrangement is provided about the connection of the prime mover drive shaft to the base plate. That seal arrangement includes a lubricant collection chamber between the seals, and control air is used to recycle lubricant from that chamber to the air inlet of the compressor. Preferably, the base plate is formed from two mating cast members with the lubricant flow path integrally formed therein and defined through structural webs of the castings.

13 Claims, 9 Drawing Sheets

ENCAPSULATED ROTARY SCREW AIR COMPRESSOR

This is a Continuation of U.S. application Ser. No. 08/566,527 filed Dec. 4, 1995, abandoned.

BACKGROUND AND SUMMARY OF THE INVENTION

The present invention relates generally compressor systems, and, more particularly, to housing arrangements, drive transmissions and lubricating fluid treatment for rotary screw air compressors.

Rotary screw air compressor systems are well known and have a multitude of industrial applications. A number of such compressor systems have been offered for sale by the Sullair Corporation of Michigan City, Ind., U.S.A. for many years, such as the "LS" and "ES" series product lines. Prior patents showing exemplary systems and components thereof include U.S. Pat. Nos. 4,420,292, 4,563,138 and 5,388,967. Reference is specifically incorporated herein to those products and patents for functional background.

In general, compressor systems include a prime mover, such as an electric motor or internal combustion engine, driving a screw compressor through a rotational transmission. The working fluid to be compressed is, for example, air. The lubrication circuit for the screw compressor typically includes a fluid filter, an air/oil or air/lubricant separator, a fluid cooling circuit and a fluid sump or reservoir. In some prior systems, each component of the lubrication circuit was separately housed and independently mounted to the system platform with separate pipes and conduits connected between each component. Those arrangements permitted each component to be separately accessible, but resulted in a relatively long circuit which required a greater volume of lubricating fluid to be used. Since the lubricating fluid is periodically replaced, the greater volume of fluid requires greater maintenance cost and greater environmental impact in disposal. Also, the multitude of pipe and conduit connections requires greater system bulk and assembly time and increases the possibility of leakage. Further, such relatively complex systems tended to increase manufacturing and service costs by the larger variety of inventory required for timely work.

In an effort to reduce such costs, improve reliability and control system size, it has previously been suggested to encapsulate all or most of the lubricating circuit components and the compressor within a common housing. In effect, a bell housing was formed over a plurality of those components with the fluid flow path for the lubricant defined by chambers within that bell. Such systems have been widely marketed by Sullair Corporation as the ES-6 and ES-8 product lines.

The object of the present invention is to improve upon such encapsulated compressor systems, as particularly applied to larger capacity compressors of 40 horsepower and more, although the same principles can be advantageously applied to smaller capacity compressors. In general, it has been found to be desirable to:

a. reduce the costs of system manufacture, maintenance and servicing, b. decrease the possibility of lubricant leaks even further, c. extend the useful life of critical system components, d. increase the ease of field servicing, e. control the size of the system such that it can fit within a standard 34 inch door opening, and f. increase the ease of mobility of the system by an overall configuration that is transportable by a standard forklift and/or hand truck.

These and other objects and advantages are attained by the provision of a rotary screw compressor system wherein the base plate connecting the prime mover to the compressor integrates the drive transmission with the lubricating fluid flow path between lubricating circuit components. Each of those circuit components and the compressor is removably mounted to the base plate via segregating housings. The compressor is mounted to the base plate with drive shaft and working fluid outlet on the same side. A pre-separation chamber is included within the base plate to facilitate removal of lubricant from the compressed working fluid prior to passage of the working fluid through the separator component. A double seal arrangement is provided about the connection of the prime mover drive shaft to the base plate. That seal arrangement includes a lubricant collection chamber between the seals, and control air is used to recycle lubricant from that chamber to the air inlet of the compressor. Preferably, the base plate is formed from two mating cast members with the lubricant flow path integrally formed therein and defined through structural webs of the castings.

Such a system accomplishes the above-referenced objectives in several ways. For example, encapsulating the lubricant flow path within the base plate eliminates the need for connecting pipes and conduits. That permits reduced inventory, simplifies manufacturing and service assembly, reduces leaks, and significantly reduces the volume of lubricant needed for efficient system operation. Segregating housings for lubrication circuit components and the compressor permits separate servicing and replacement, often with a minimum of oil loss, especially during in field maintenance. Integrating the lubricant flow path and the drive transmission housing reduces overall system size and weight, with resultant cost savings and increased mobility. Scavaging a recycling lubricant from the prime mover drive shaft seals similarly decreases leakage and permits cost savings in system site maintenance and lubricant replacement. Further, constructing the compressor to have its output and drive shaft on the same side can permit balancing of forces to decrease bearing wear and increase the useful life of the compressor.

These and other objects, advantages and novel features of the present invention will become apparent to those of skill in the art from the drawings and following detailed description.

DETAILED DESCRIPTION OF PREFERRED EMBODIMENTS

Figure 1:
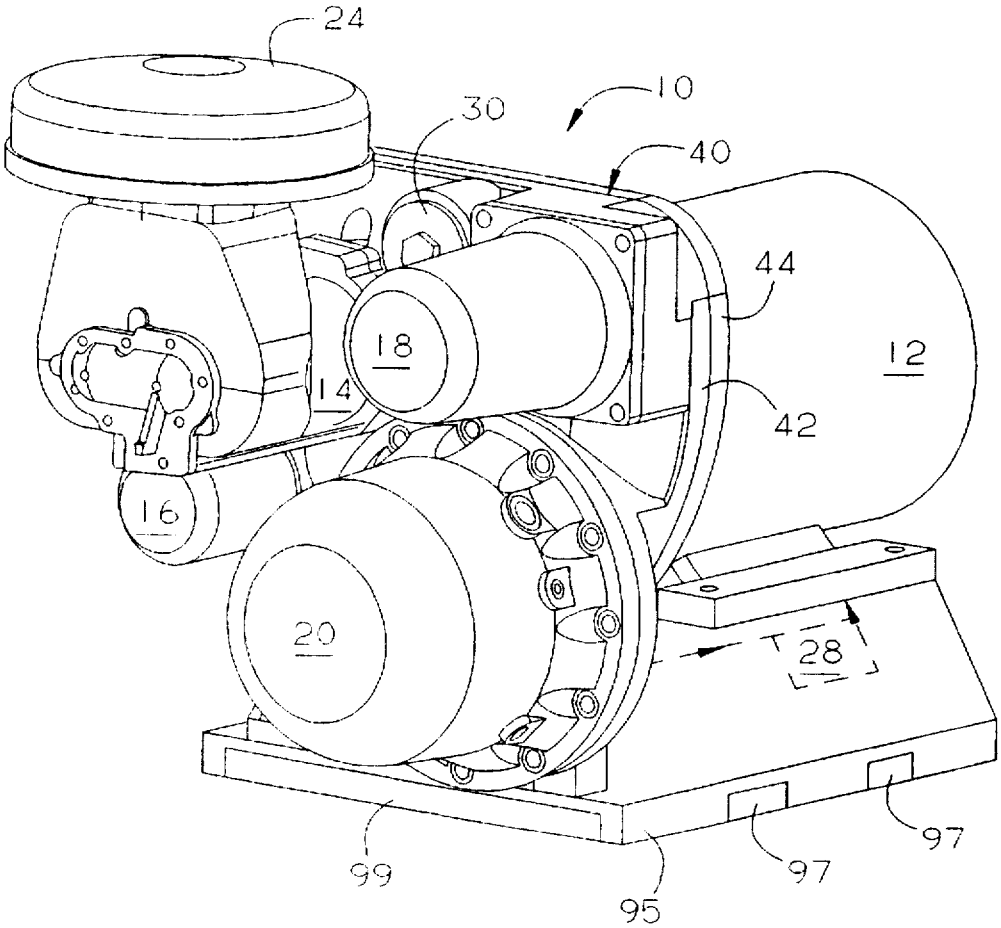
FIG. 1 shows a front, right perspective view of a rotary screw air compressor system incorporating the present invention.
Figure 2:
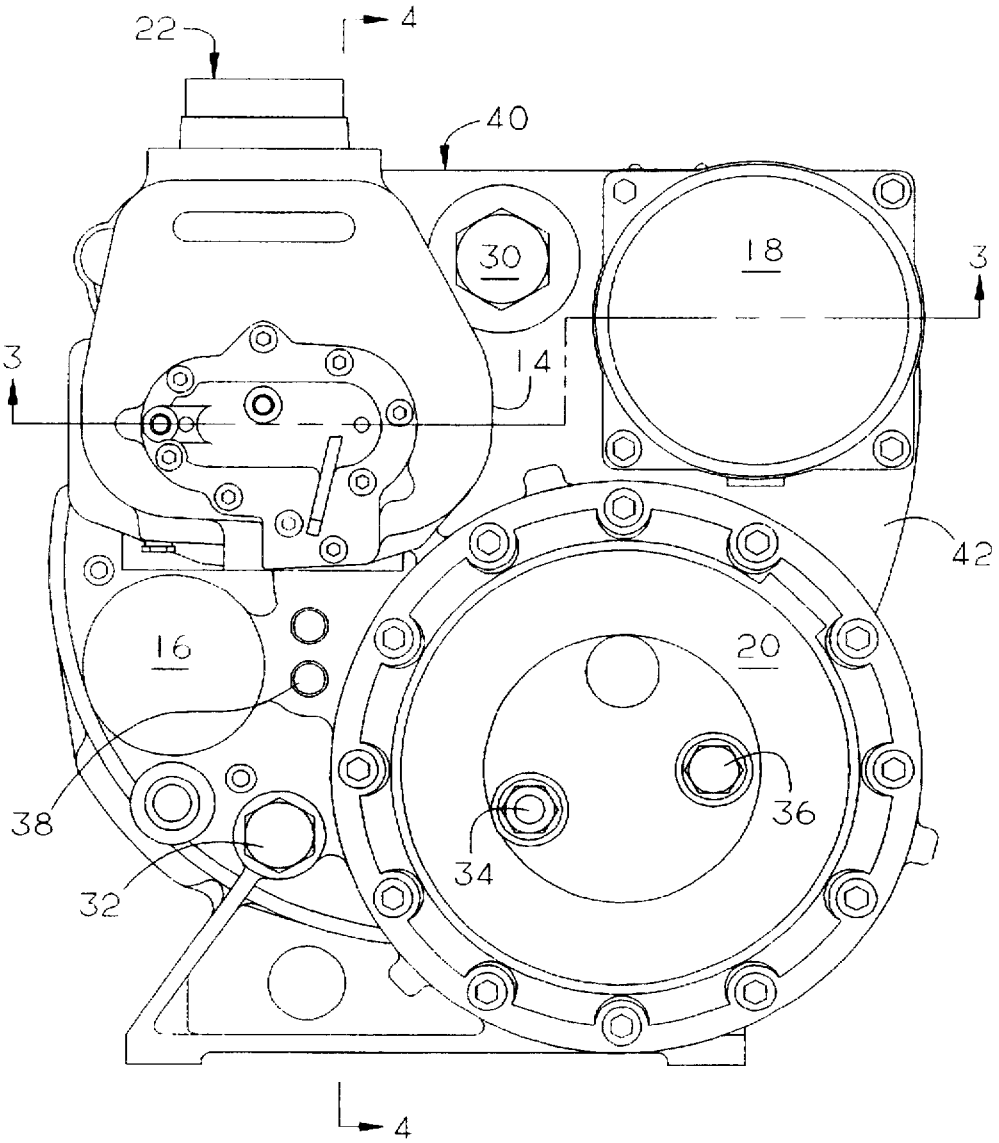
FIG. 2 shows a front view of the compressor system of FIG. 1.

FIG. 1 shows a rotary screw compressor system 10 which incorporates the present invention. In preferred embodiments the compressor working fluid is air and the compressor/prime mover size is at least 40 horsepower. Except for the system size, component packaging and housing features described herein, preferred embodiments are substantially the same as the commercially available ES-6 and ES-8 products. In general, each drawing herein is not made to the same scale as all other drawings herein.

As illustrated in FIGS. 1–4A, compressor system 10 includes a prime mover 12, a rotary screw compressor 14, and a lubrication circuit including a plurality of components: fluid filter 16, air/lubricant separator 18 and fluid reservoir or sump 20. Compressor 14 includes an air inlet 22, an air filter 24 mounted between air inlet 22 and the atmospheric air supply, and an air inlet valve 26 for controlling the supply of air to compressor 14. Compressor system 10 also typically includes lubricant cooling circuit 28, minimum pressure valve 30, thermal valve 32, fluid level indicators 34 and 36, and temperature gauge 38. All of these components are conventional and generally perform the same functions as in prior ES-6 and ES-8 products. The connection of prime mover 12, compressor 14 and the lubrication circuit is however, quite distinct.

Compressor system 10 includes a base plate 40 formed from two mating, cast elements 42 and 44. When these mating cast elements are assembled, an enlarged opening 46 is formed on the back side. In especially preferred embodiments, cover plate 48 is provided to receive a drive shaft and cover opening 46.

Elements 42 and 44 are configured to form an internal cavity 50 when mated together, such as by conventional bolts 51. Cavity 50 is configured to receive drive transmission 52 therein as well as the fluid flow path connecting the lubrication circuit components. Also, prime mover 12 is provided with an output drive shaft 54 which is received within cavity 50 through cover plate 48. Similarly, compressor 14 is provided with an input drive shaft 56 which is received within cavity 50.

Figure 4:
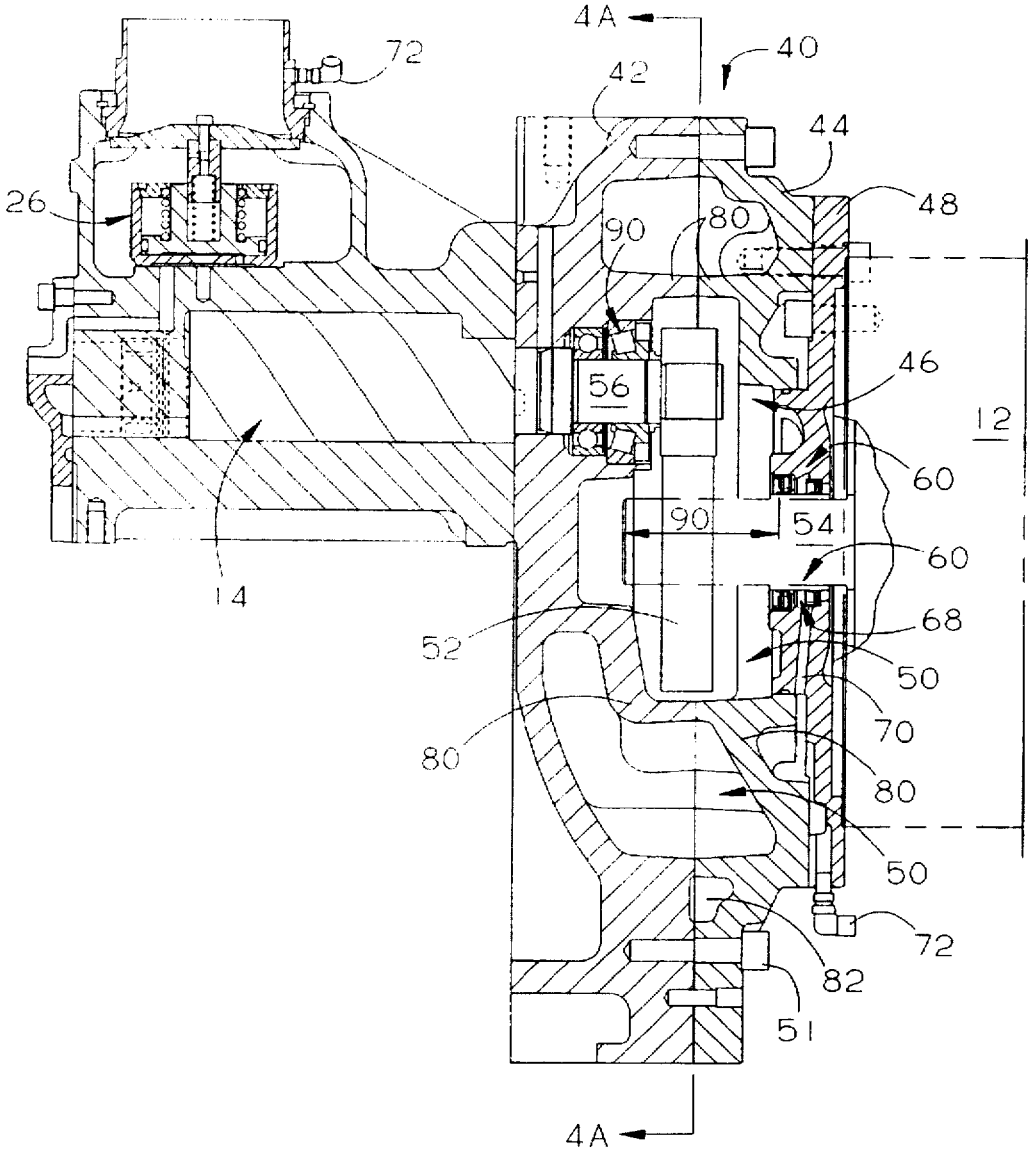
FIG. 4 shows a partial cross-sectional side view taken along line 4—4 of FIG. 2.
Figure 4A:
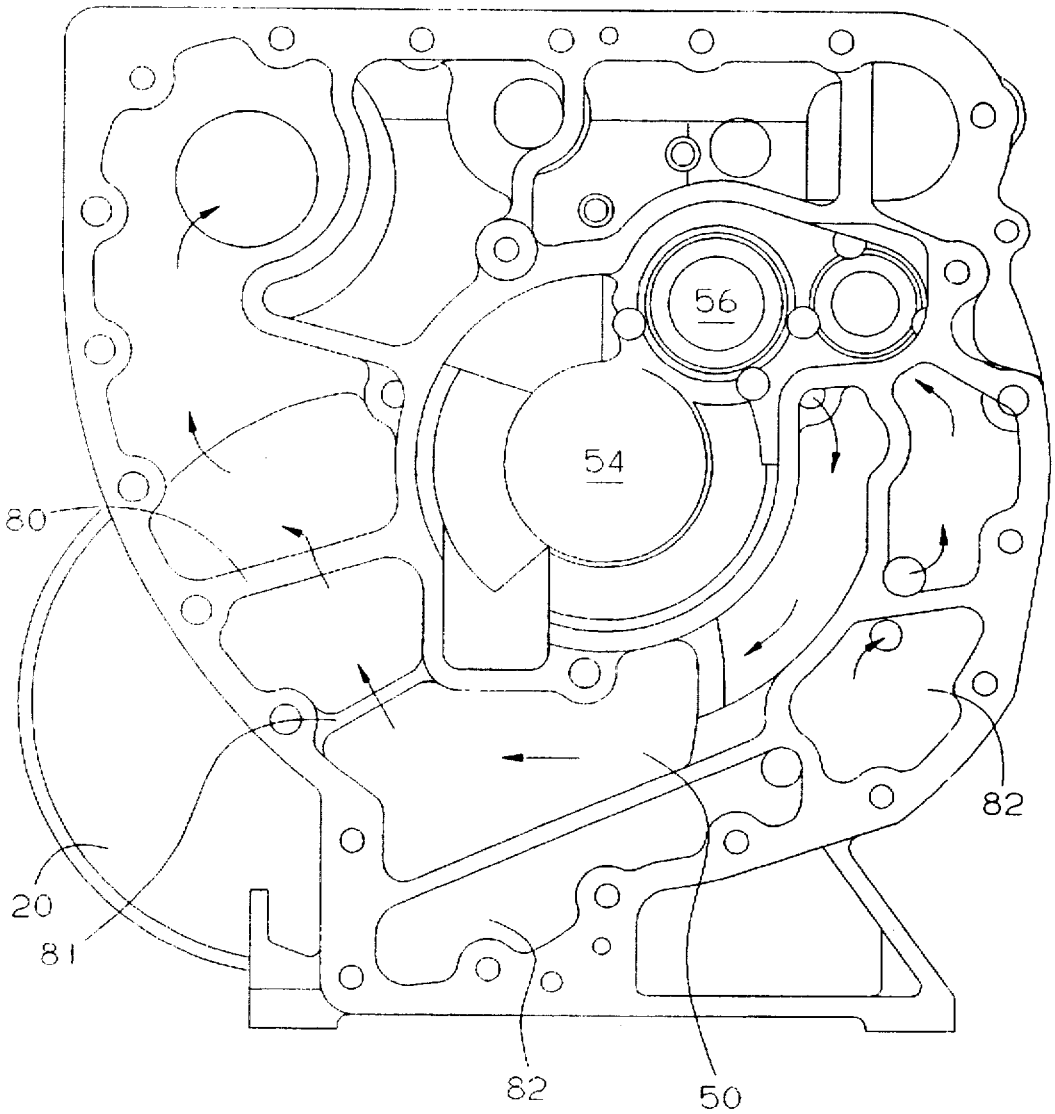
FIG. 4A shows a partial cross-sectional view taken along line 4A—4A of FIG. 4, illustrating the lubricant flow path.
Figure 5:
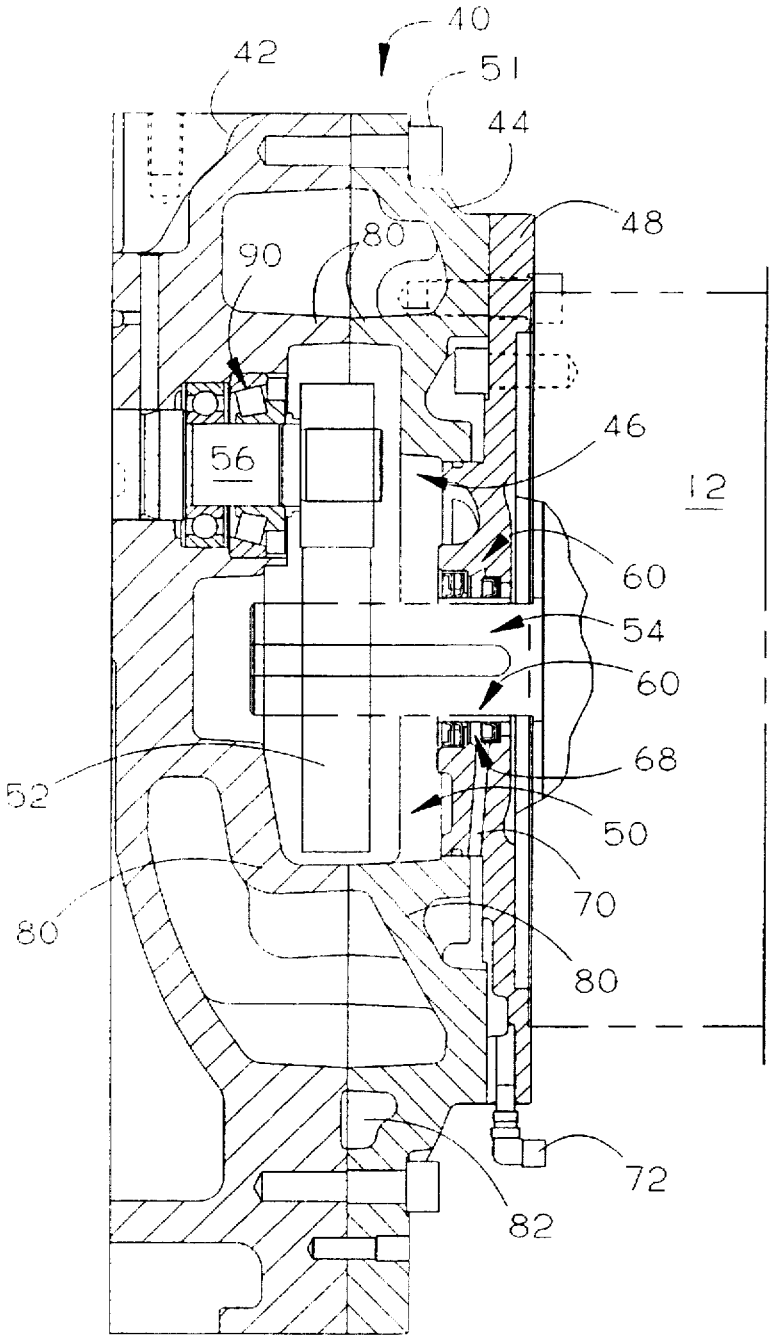
FIG. 5 shows a partial cross-sectional side view corresponding to a portion of the view of FIG. 4, but with an alternative drive transmission arrangement.
Figure 6:
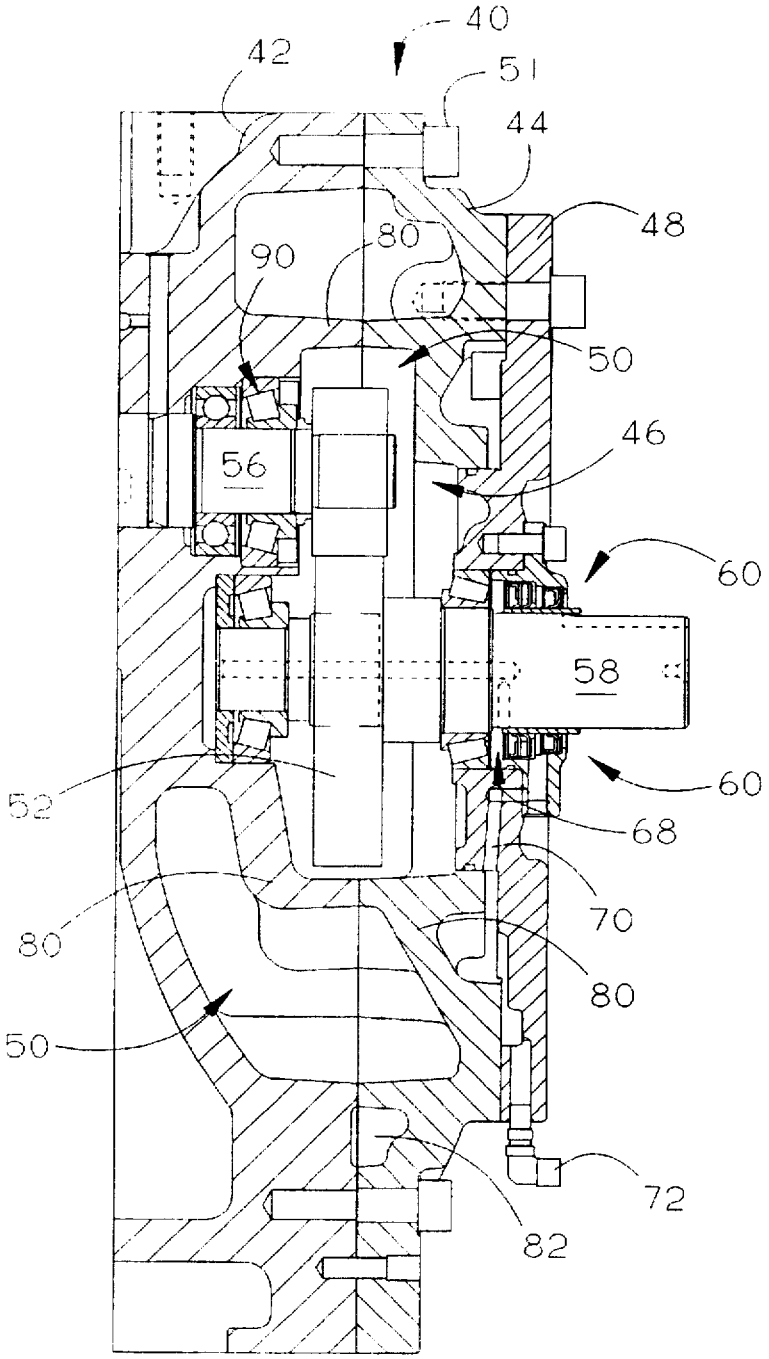
FIG. 6 shows a partial cross-sectional side view corresponding to a portion of the view of FIG. 4, but with yet another alternative drive transmission arrangement.
Figure 7:
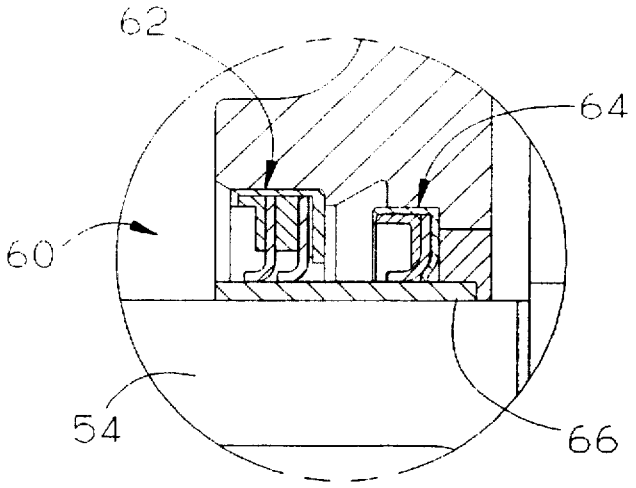
FIG. 7 is an enlarged cross-sectional view of the prime mover drive shaft seal shown in FIG. 4.
Figure 8:
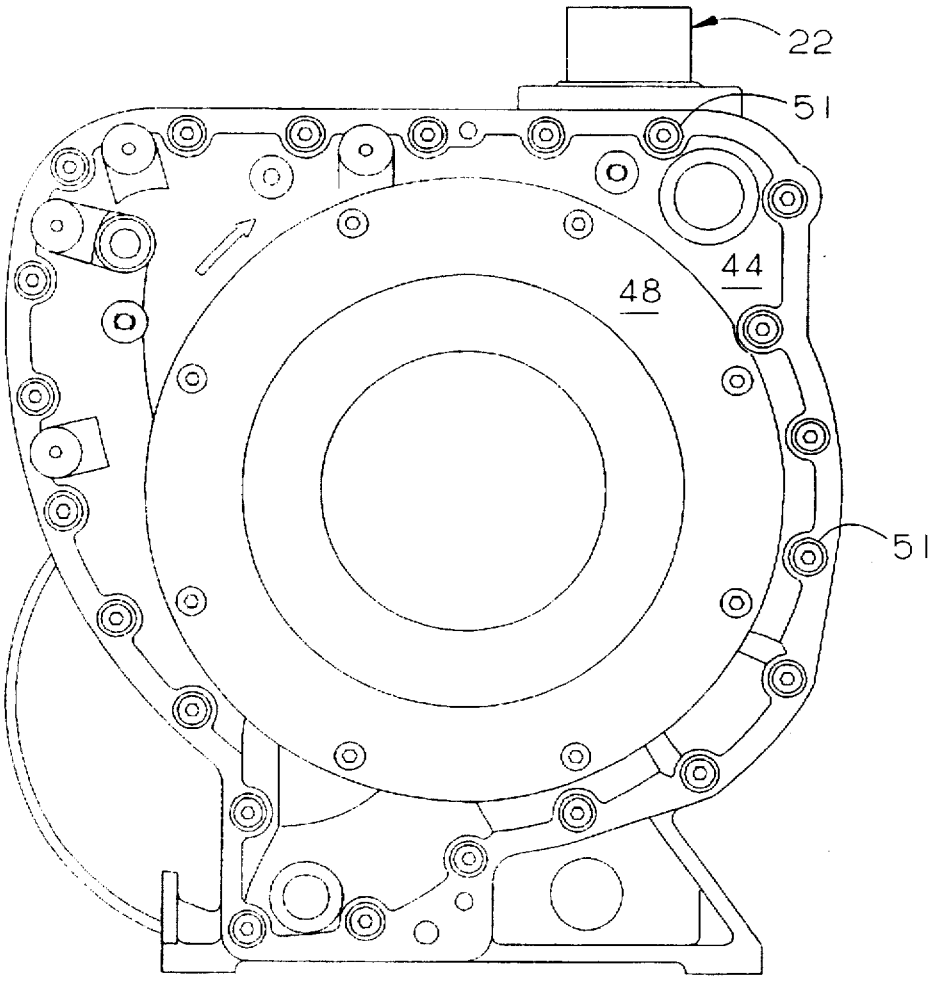
FIG. 8 is a back view of the base plate shown in FIG. 2.

FIGS. 4–6 show the use of alternative drive transmissions within cavity 50. In FIG. 4, drive transmission 52 is shown to be formed as a conventional gear drive for a U.S. styled motor as the prime mover. In FIG. 5, drive transmission 52 is shown to be formed as a conventional gear drive for a European styled motor as the prime mover. In FIG. 6, drive transmission 52 includes an intermediate shaft 58 for use where the prime mover is not integrated with compressor system 10 until installation at the work site. Such situations can, for example, arise where compressor system 10 is designed for operation with a variety of different prime movers supplied by the end user.

Drive shaft 54 and, where used, intermediate shaft 58 are provided with a seal arrangement 60 to restrict fluid leakage out of cavity 50, particularly lubricating fluid. This seal arrangement includes first seal element 62 and second seal element 64 riding on seal sleeve 66 about the circumference of a portion of shaft 54 or 58. In especially preferred embodiments, a fluid collection chamber 68, including return passageway 70, is formed between seals 62 and 64. Preferably, seal 62 is formed as a double Teflon® lip seal with a spiral groove, such as with Part No. DSSK11547 of John Crane, Inc. of Lyle, Ill., U.S.A. Preferably, seal 64 is formed as a single Teflon® lip seal, such as with Part No. DSSK11548 of John Crane, Inc.

Relatively small quantities of fluid seeping into chamber 68 can collect in passageway 70 during compressor operation. Passageway 70 is connected to air inlet 22 via the conventional control air line 72 to air inlet valve 26. When it is desirable to close air inlet valve 26, as in compressor unloading or shut down, control air is forced through line 72, driving fluid out of passageway 70 and up to air inlet 22 for recycling. From the air inlet this fluid joins the lubricant provided to compressor 14 by the lubrication circuit.

Unlike in prior compressor systems, compressor 14, fluid filter 16, separator 18 and reservoir 20 are provided with separate housings which segregate them from each other and are removably attached to base plate 40. Preferably, all such attachments are made via bolts 74 to the same side of base plate 40. All fluid passageways between those elements of the lubrication circuit and with the compressor are made internally of base plate 40. It is also contemplated that in certain embodiments reservoir 20 can be completely integrated within base plate 40 and eliminated as a separate attachment.

Where compressor system 10 is sized to have a horsepower rating similar to that of the ES-6 and ES-8 products, fluid filter 16 and separator 18 can be formed similarly to the corresponding elements of those products. However, where compressor system 10 is sized for 40 horsepower and above, it is recommended that filter 16 and separator 18 be sized upwardly in a conventional manner to handle the greater load and that the lubricant be equivalent to Sullube 32® brand lubricant, a commercially available product of Sullair Corporation. Further, in preferred embodiments separator 18 would also differ from the corresponding separator used in ES-8 products by not including a piston orifice to bleed air.

Cavity 50 includes the lubricant flow path along with drive transmission 52. Specifically, elements 42 and 44 are cast to form a plurality of chambers separated by structural webs 80. Conventional passageways 82 are formed between these chambers according to any desired orientation of components attached to base plate 40. In the preferred embodiment shown, such passageways would guide lubricant flow from reservoir 20 to external cooling circuit 28 (shown schematically in FIG. 1), then to filter 16, then to compressor 14, and then to cavity 50 for "pre-separation" of lubricant entrained with the compressed air. This pre-separation can be accomplished by a series of conventional means within the chambers of cavity 50.

For example, the compressed air/lubricant mixture can be directed into an enlarged chamber to reduce its velocity, then directed against an impingement surface 81 of the chamber, then directed into a circular flow path within the chamber to induce centrifugal separation, and then directed along a tortuous, reversing flow path for further surface impingement. The lubricant thereby removed from the mixture is preferably directed by such passageways to return to the reservoir. The remaining mixture is directed to separator 18. Lubricant removed by separator 18 is, for example, directed back to cavity 50 for impingement on drive transmission 52 and any bearings supported in cavity 50. Lubrication of compressor bearings may become again mixed with the compressor air output of compressor 14, and lubrication of drive shaft 54 or intermediate shaft 58 can become recycled to compressor 14 as well through passageway 70.

Figure 3:
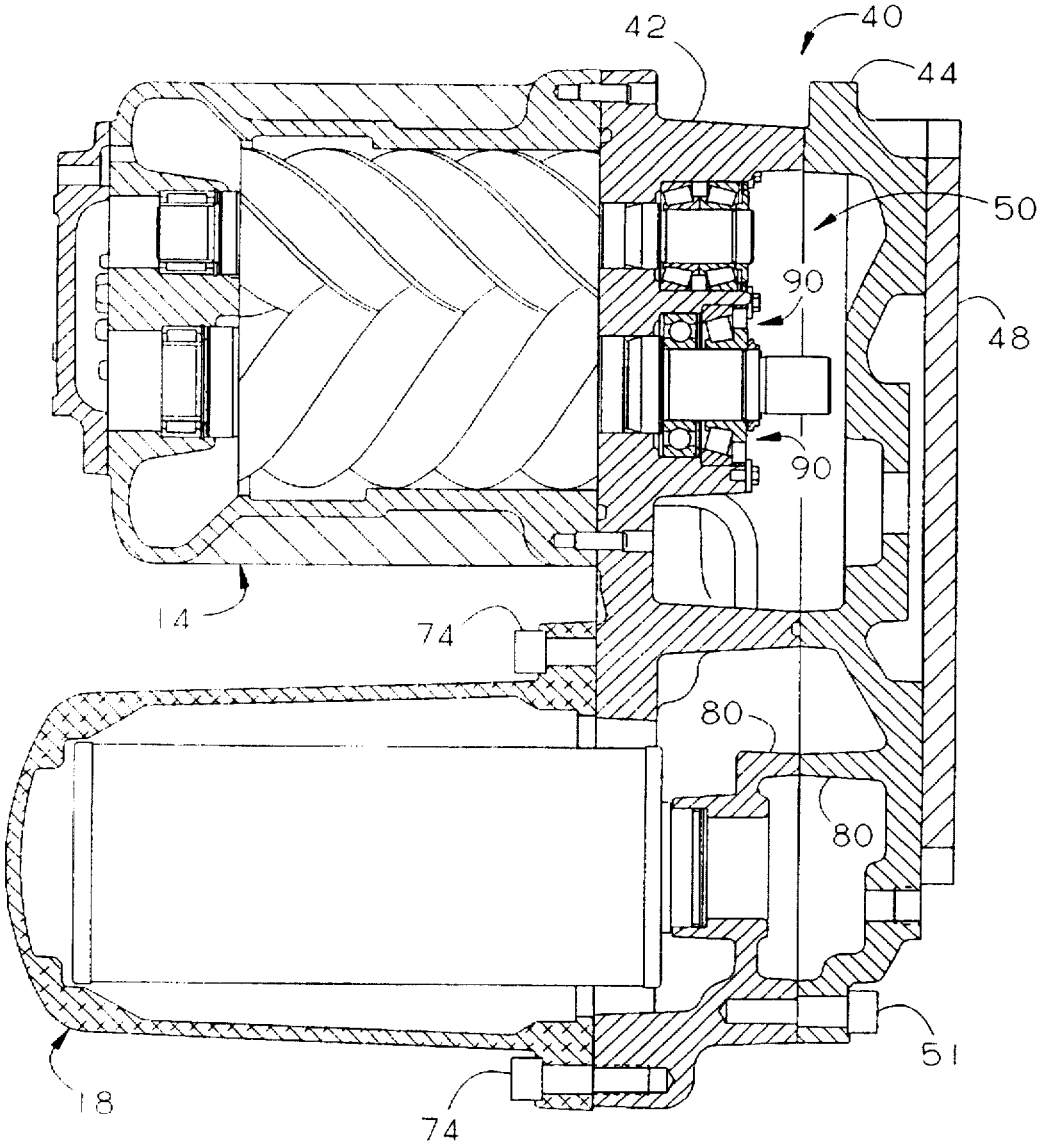
FIG. 3 shows a cross-sectional top view taken along line 3—3 of FIG. 2.

As shown in FIGS. 3 and 4, compressor 14 is arranged to have its working fluid outlet on the same side as input drive shaft 56. That drive shaft is supported within cavity 50 by bearings 90. Such an arrangement is preferred since it appears to balance the forces exerted on bearings 90 and prolong the useful life of bearings 90.

The arrangement of the present invention provides a particularly compact product in which each principle component is easily accessible. Moreover, this product can be mounted on a relatively small platform 95 having openings 97 to receive a forklift on the sides and openings 99 to receive a hand truck on the ends.

Although the present invention has been described above in detail with respect to preferred embodiments, the same is by way of illustration and example only and is not to be taken as a limitation. The spirit and scope of the present invention are limited only by the terms of the claims below.

What is claimed is:

1. A compressor system comprising:

a prime mover, a compressor, a power transmission means connecting the prime mover to the compressor for permitting the prime mover to drive the compressor, a lubrication circuit for supplying lubricant to the compressor, the lubrication circuit having a plurality of discrete functional components therein connected by a flow path, the plurality of discrete functional components including a fluid filter, a fluid reservoir, and an air/lubricant separator, a base means for coupling said prime mover to said compressor, the base means including a first and second mating member, each of which is integrally cast to form part of an enclosed cavity therein for receiving the power transmission means, that cavity also defining the flow path between the functional components of the lubrication circuit, and each of the functional components of the lubrication circuit including a component housing, removably attached to the base means, for segregating the lubricant flow for that component.

2. The compressor system according to claim 1 wherein the compressor is formed as a single stage rotary screw compressor having an outlet to the base plate cavity adjacent the compressor drive input from the power transmission means.

3. The compressor system according to claim 1 wherein the prime mover includes a output drive shaft, the base means receives one end of the output drive shaft within the cavity, the compressor includes an input drive shaft, the base means receives an end of the input drive shaft within the cavity, the power transmission means including a movable, mechanical connection between the output drive shaft and the input drive shaft.

4. The compressor system of claim 1, wherein said base means includes openings adapted to receive forklifts and handtrucks for transportation of the compressor system.

5. The compressor system according to claim 1 wherein the flow path of the base means receives compressed air with entrained lubricant from the compressor and includes pre-separation means for removing a portion of the lubricant from the compressed air prior to passage of the compressed air and entrained lubricant into the air/lubricant separator.

6. The compressor system according to claim 5 wherein the pre-separation means includes a velocity drop chamber, air flow impingement plate and a tortuous path through the cavity in a series flow relation.

7. A compressor system comprising:

a prime mover;

a compressor including an air inlet for supplying working fluid to the compressor;

a power transmission means connecting the prime mover to the compressor for permitting the prime mover to drive the compressor;

a lubrication circuit for supplying lubricant to the compressor, the lubrication circuit having a plurality of discrete functional components therein connected by a flow path;

a base means for coupling the prime mover to the compressor, the base means including an enclosed cavity therein for receiving the power transmission means, the cavity also defining the flow path between the functional components of the lubrication circuit; and a seal arrangement provided in the base means to surround a portion of the output drive shaft to prevent leakage out of the cavity, that seal arrangement including a first seal member, a second seal member, a fluid collection means between the first and second seal members for receiving fluid seepage between those members, and recycling means for removing lubricant from the fluid collection means and providing that lubricant into the lubrication circuit via the air inlet means when the compressor system is unloaded or shut down;

wherein each of the functional components of the lubrication circuit includes a component housing removably attached to the base means for segregating the lubricant flow for that component.

8. The compressor system of claim 7, wherein said base means includes openings adapted to receive forklifts and handtrucks for transportation of the compressor system.

9. A compressor system comprising:

a prime mover including an output drive shaft;

a compressor including an input drive shaft;

a power transmission means connecting the prime mover to the compressor for permitting the prime mover to drive the compressor, the power transmission means including a movable mechanical connection between the output drive shaft and the input drive shaft;

a lubrication circuit for supplying lubricant to the compressor, the lubrication circuit having a plurality of discrete functional components therein connected by a flow path;

a base means for coupling said prime mover to said compressor, the base means including an enclosed cavity therein for receiving the power transmission means, one end of the input drive shaft, and one end of the output drive shaft, the base means including a first and second mating member, each of which is integrally cast to include a portion of the cavity by interconnecting chambers separated by structural webs, the mating members being bolted together to form the enclosure of the cavity, the interconnecting chambers, structural webs, and cavity defining the flow path between the function components of the lubrication circuit; and each of the functional components of the lubrication circuit including a component housing removably attached to the base means for segregating the lubricant flow for that component.

10. The compressor system of claim 9, wherein said base means includes openings adapted to receive forklifts and handtrucks for transportation of the compressor system.

11. The compressor system according to claim 9 wherein the functional components of the lubrication circuit include a lubricant fluid filter and an air/lubricant separator arranged with respect to the flow path such that lubricant passes through the fluid filter, then into the compressor, then into the cavity, then into the air/lubricant separator.

12. The compressor system according to claim 11 wherein a fluid reservoir is provided as another functional component of the lubrication circuit for receiving lubricant from the air/lubricant separator and providing lubricant to the fluid filter.

13. The compressor system according to claim 11 wherein the cavity also includes a fluid reservoir in the flow path for receiving lubricant from the air/lubricant separator and providing lubricant to the fluid filter.

* * * * *